United States Patent [19]

Reitman

[11] Patent Number: 4,942,388

[45] Date of Patent: Jul. 17, 1990

[54] REAL TIME COLOR DISPLAY

[75] Inventor: William Reitman, Santa Ana, Calif.

[73] Assignee: Grumman Aerospace Corporation, Bethpage, N.Y.

[21] Appl. No.: 902,584

[22] Filed: Sep. 2, 1986

[51] Int. Cl.[5] ..... G09G 5/04

[52] U.S. Cl. ..... 340/701; 340/703; 340/704

[58] Field of Search ..... 340/703, 793, 767, 701, 340/704; 358/74, 168

[56] References Cited

U.S. PATENT DOCUMENTS

| | | | |
|---|---|---|---|
| 3,624,634 | 11/1971 | Clark | 340/745 |
| 3,648,250 | 3/1972 | Low et al. | 340/793 |
| 3,686,662 | 8/1972 | Blixt et al. | 340/703 |
| 3,849,793 | 11/1974 | Albett | 358/81 |
| 3,886,588 | 5/1975 | Dalke | 358/82 |
| 3,941,926 | 3/1976 | Slobodzian et al. | 340/793 |
| 4,025,946 | 5/1977 | Casey | 358/81 |
| 4,183,046 | 1/1980 | Dalke et al. | 358/22 |
| 4,232,311 | 11/1980 | Agneta | 340/703 |
| 4,310,838 | 1/1982 | Juso et al. | 340/701 |
| 4,352,105 | 9/1982 | Harney | 340/703 |
| 4,467,322 | 8/1984 | Bell et al. | 340/704 |
| 4,549,172 | 10/1985 | Welk | 340/703 |
| 4,626,835 | 12/1986 | Nienaber et al | 340/703 |
| 4,689,613 | 8/1987 | Ikeda | 340/701 |

FOREIGN PATENT DOCUMENTS

| | | | |
|---|---|---|---|
| 2032740 | 10/1978 | United Kingdom | 340/703 |
| 2167926 | 4/1986 | United Kingdom | 340/703 |

*Primary Examiner*—Alvin E. Oberley
*Assistant Examiner*—Richard Hjerpe
*Attorney, Agent, or Firm*—Stetina and Brunda

[57] ABSTRACT

A real time color display system forn converting input data to color drive signals is disclosed, which permits individual color intensity signals corresponding with individual data input signals to be selectively varied. The display system comprises an interface circuit connectable to an external data source and first connector terminals of a progammable device. A memory access circuit is connectable to the data source and second connector terminals of the programmable device. The memory access circuit comprises circuitry for generating address information and is adapted to transfer data and corresponding address information to the second connector terminals of the programmable device. A video circuit is also connected to the programmable device and to the data source. The video circuit comprises color registers for storing color drive signals, color coding circuitry for loading the color registers and color translating circuitry for communicating data to the color registers.

7 Claims, 6 Drawing Sheets

INPUT/OUTPUT INTERFACE CIRCUIT

DIRECT MEMORY ACCESS CIRCUIT

DIRECT MEMORY ACCESS CIRCUIT

VIDEO PROCESSING CIRCUIT

VIDEO PROCESSING CIRCUIT

VIDEO PROCESSING CIRCUIT

REAL TIME COLOR DISPLAY

BACKGROUND INFORMATION

The present invention relates to systems for generating color displays from various types of input information. More particularly, this invention relates to a system for interfacing a commercially available programming device, such as a personal computer with a data source and a color display, with minimal load on the storage and processing facilities of the programming device.

In the field of color displays, a variety of systems have been proposed for real time color imagery of input information. Such systems function to translate input signals into color drive signals used to generate multicolor images. The displayed images may illustrate models or other objects to be tested. Changing conditions may be depicted in real time on the display. For example, when the temperature of an object is of interest, the color of each portion of the displayed image may be a function of the actual or anticipated temperature of that respective portion. Hotter portions may be illustrated in red, with the hottest portions being a more intense red.

Color and/or intensity variations may also be variable in response to levels of characteristics such as light, magnetic field, moisture, vibration, or response to interrogation signals. Though the information processing in each case may be substantially different, the display system in each case is operative to respond to some changeable parameter by varying the color and/or the intensity of the displayed image.

Though numerous systems have been proposed for processing information to generate a color display responsive to changes in input signals, those systems combine in a single unit. Those devices incorporate the capacity to generate a signal stream to set up color coding registers (for correlating input information and color or intensity signals), and the capacity to translate the input data through those registers after they have been color coded. Thus, the same device includes both circuitry for generating a signal stream to set up or code the color registers in relation to input information, and circuitry for subsequently translating the input information through those registers after they have been color coded.

In some applications color coding and color translating require interpretation of vast flows of data. Dedicated software and hardware architectures with complex microelectronics may be necessary to translate the input information into color drive signals. The costs of such systems, including dedicated hardware and software components is typically high. However, in other applications, it may be desirable to segregate the coding and translating functions in different devices in order to utilize the most efficient and most economical means for performing each function.

SUMMARY OF THE INVENTION

The present invention is intended to provide an alternative to complex devices that include integral means for coding and processing input information. The present invention interfaces, between the information source, a programable processor and a color display. In the present invention color coding functions are performed through the facilities of a commonly available programable processor, programming device, such as a personal computer, and the ongoing translating or processing functions are performed substantially independent of the personal computer, and without interference in the computer's other functions. The invention utilizes the computer's processing ability to color code a plurality of color registers disposed on a module that is readily connectable to the output ports of the personal computer. Upon completion of the color coding, the input information is directed to the coded registers for translation into color drive signals, without the requirement for any further processing functions by the personal computer. Thus, once the color coding is set up in the registers, the processing systems of the personal computer are bypassed until some color adjustment or supervisory function is to be performed. Because the color translation functions are performed within the circuitry of the present invention, in response to unprocessed information from the data source, the invention performs ongoing color translation in a manner that does not detract from the ability of the personal computer to simultaneously perform other functions. The dedicated computer memory space to implement the color imagery of input information is limited to the space needed to store routines for setup of the color register and color adjust service programs.

Accordingly, the present invention allows the user to utilize a personal computer to achieve economic advantages in a color display system. The user is, therefore, able to utilize an already available facility, i.e., the personal computer, in a way similar to the way in which a television screen is utilized to depict a video game such as ping pong. In both situations the system is designed to utilize commercially available devices to implement system functions without the need for dedicated devices, in an economical manner.

Though the embodiment described and illustrated in this application is principally directed to imagery of infrared information, it is to be understood that the invention is more broadly directed to imagery of various types of information responsive to changes in different parameters.

DETAILED DESCRIPTION OF THE PREFERRED EMBODIMENT

Figure 1:
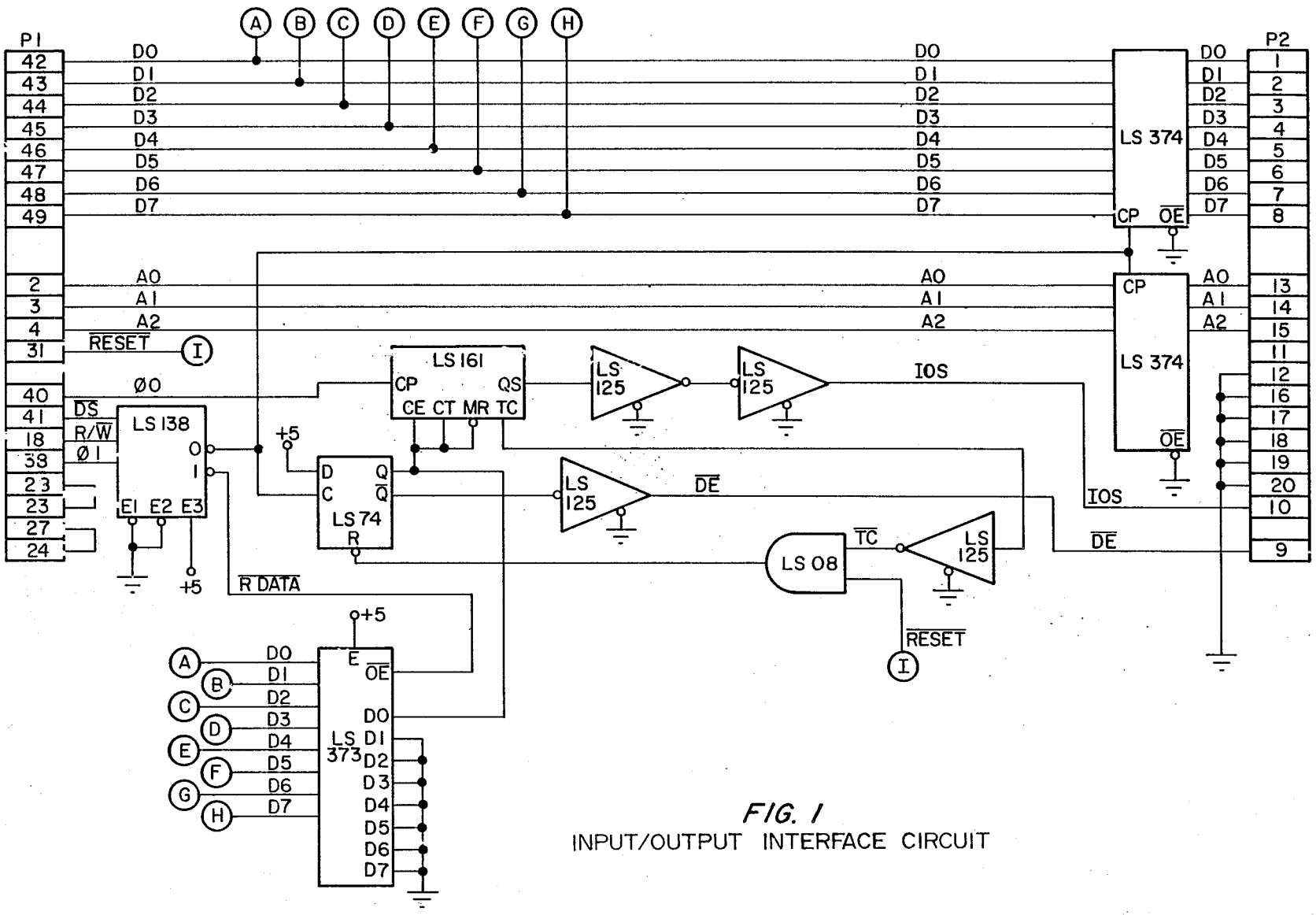
FIG. 1 is a schematic representation of the input/output interface to the present invention.

FIG. 1 illustrates the input/output interface circuit of the present invention adapted to connect the present invention to a source of data information and to a programmable machine, such as a personal computer. In the presently preferred embodiment, the input/output interface circuit is disposed on a card that connects to the slot recepticles typically provided on the computer for additional cards. The P1 connector is comprised of a slot connector adapted to be readily mated into receptacles commonly available on the personal computer. The P2 connector extends from that card and connects the input/output interface circuit to the data source to receive signals from the data source and to communicate control signals to the support electronics associated with the data source. In general, the support electronics may include a variety of different types of control circuitry adapted to receive data from the input/output interface circuit and decode that data to control the operation of data acquisition and formating functions in response to the address and data information communicated from the input/output interface circuit. In the presently preferred embodiment, the support electronics receives signals from a personal computer via the P2 connector. The support electronics decodes that information into separate functions, and sends the information to an appropriate portion of the data acquisition system depending upon the address information appearing at lines A0–A2. The support electronics decodes the data from the computer into one of a number of functions that the data acquisition system is designed to implement, sending the data to the appropriate circuit in response to the address information from the computer.

The signals from the I/O interface circuit to the support electronics include data information on lines D0–D7, address information on lines A0–A2, an input-/output strobe signal (IOS) and a data enable signal DE. The data and address information communicated from the personal computer to the support electronics via the P2 connector may implement changes in the control functions, such as modifying the gain of the input channels, or adjusting the sweep rate of the support electronics.

Referring again to FIG. 1, the P1 connector of the input/output interface circuit is preferably connected to one of a number of connector slots in the personal computer, where substantially the same signals appear in corresponding pins of each such slot. Each slot, however, may be separately addressed by a card enable signal such that the circuitry interfacing each connector slot may be activated at a particular time. The input-/output strobe (IOS) signal is also communicated to the support electronics and provides a timing link from the personal computer to the support electronics. The IOS signal is generated in response to the theta (0) signal from the P1 connector. The data enable signal, DE, is active when data to be transferred to the support electronics appears on the data lines D0–D7.

The support electronics operates to interface the display system to the source of data. In the presently preferred embodiment, the support electronics operates to generate bias, provide timing to support data acquisition, and digitize the analog information for communication to the personal computer and the video circuit. In the presently preferred embodiment, the support electronics of the present invention also operates to translate the analog information into one of sixteen possible digital sequences. Each of those sequences is correlated to a different color intensity level in the video circuit of the invention (See FIGS. 4, 5 and 6), which communicates a signal corresponding to the color intensity level to an RGB color monitor.

Figure 4:
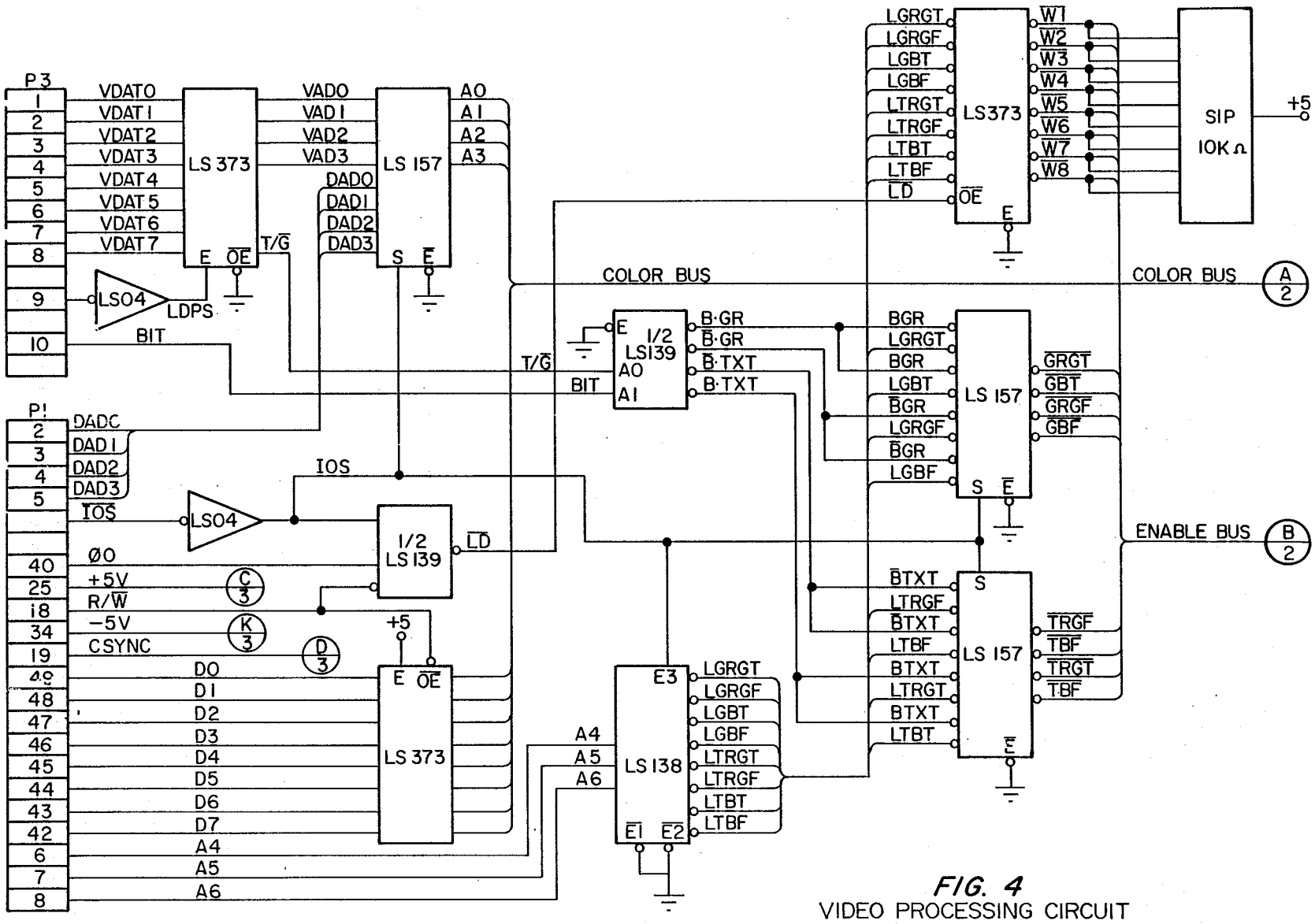
FIGS. 4, 5 and 6 are schematic representations of the video processing circuit of the invention.
Figure 5:
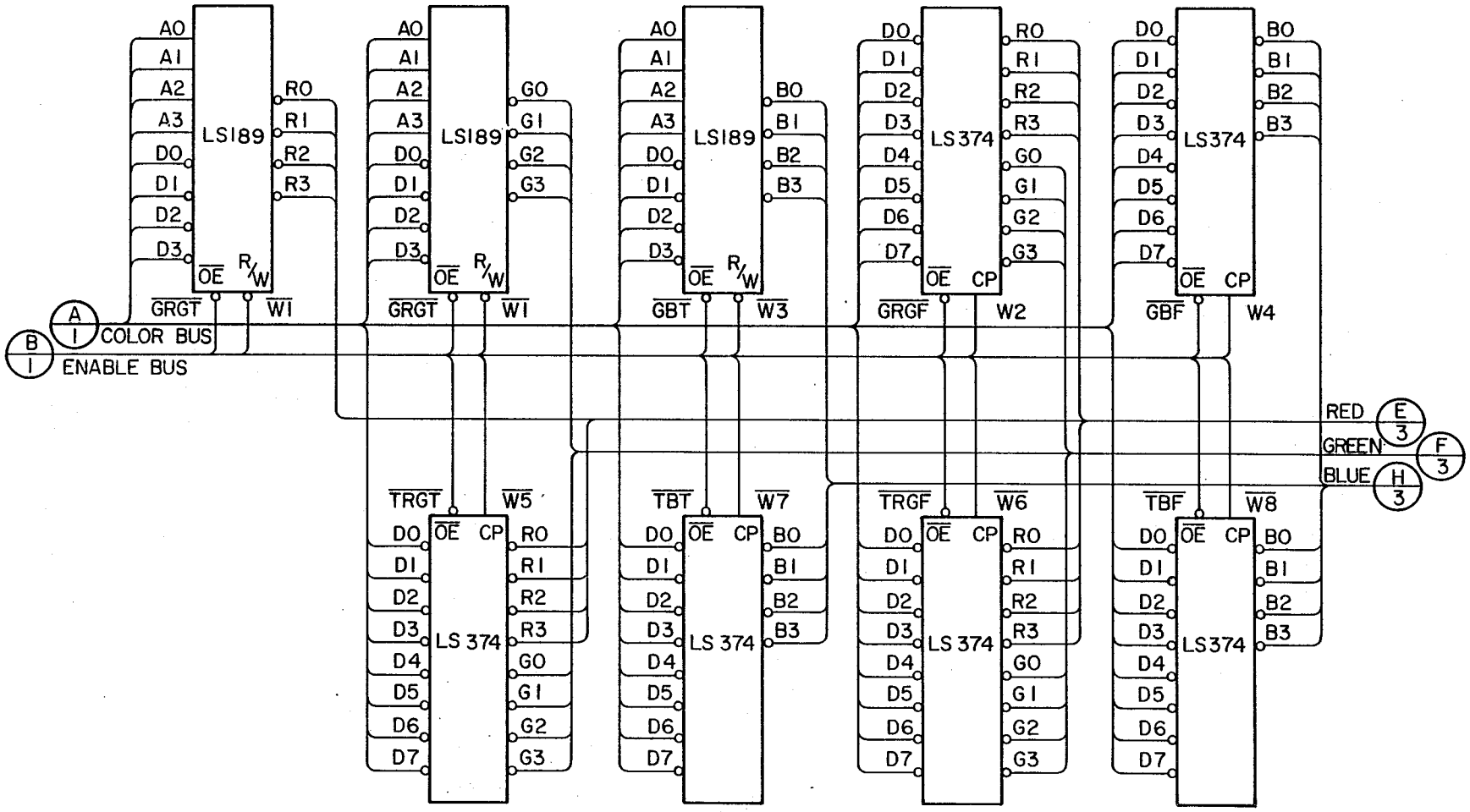
Figure 6:
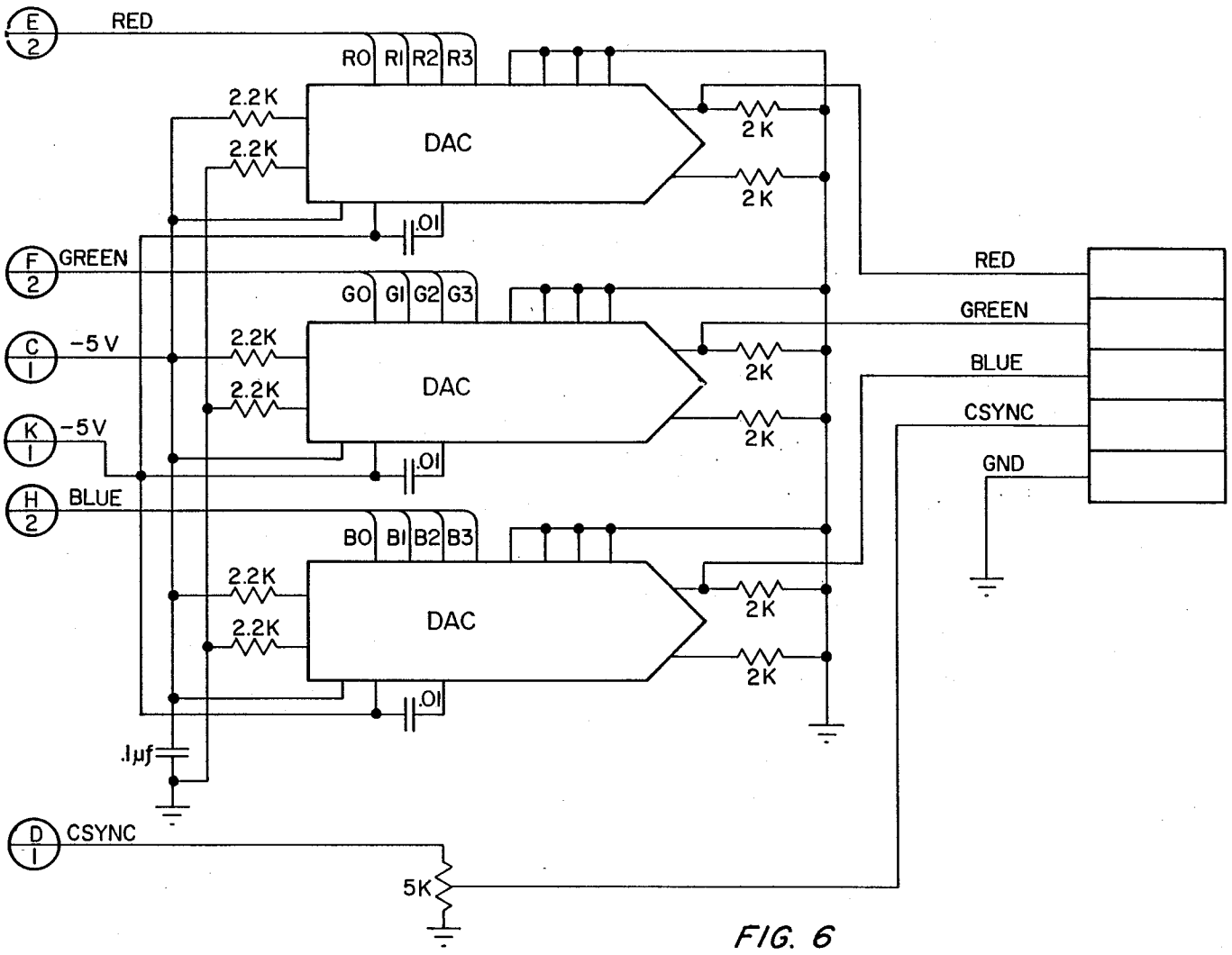

As explained in more detail, in connection with FIGS. 4, 5 and 6, the invention translates data from the data source into color intensity level signals for communication to the color monitor, without the need to utilize the programming capability of the computer. The use of the computer is thus limited to the implementation of routines to set up the video registers to correlate the data input to an output color intensity level, and to implement adjustments of the color coding to change the intensity levels. The invention is operative to facilitate modifications of the color signals associated with any one of the possible input signal sequences such that the intensities of certain colors may be selectively increased or decreased without the need to modify the color or intensity of the remaining portion of the display. Therefore, though the computer is active in the implementation of routines to code or recode the color-/intensity levels, it does not operate on the input data information once the coding has been set up.

Figure 2:
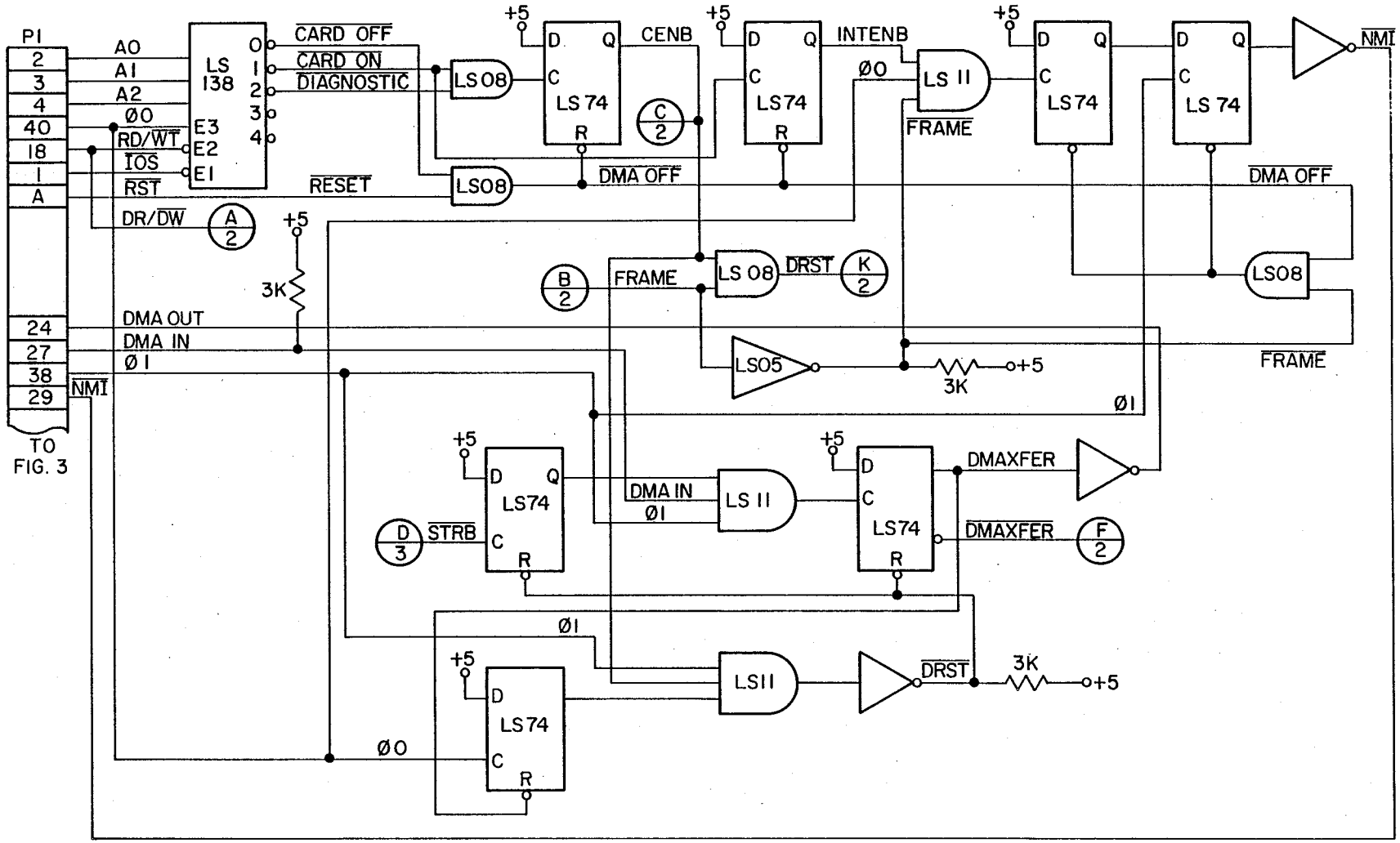
FIGS. 2 and 3 are schematic representations of the direct memory access circuit of the present invention.
Figure 3:
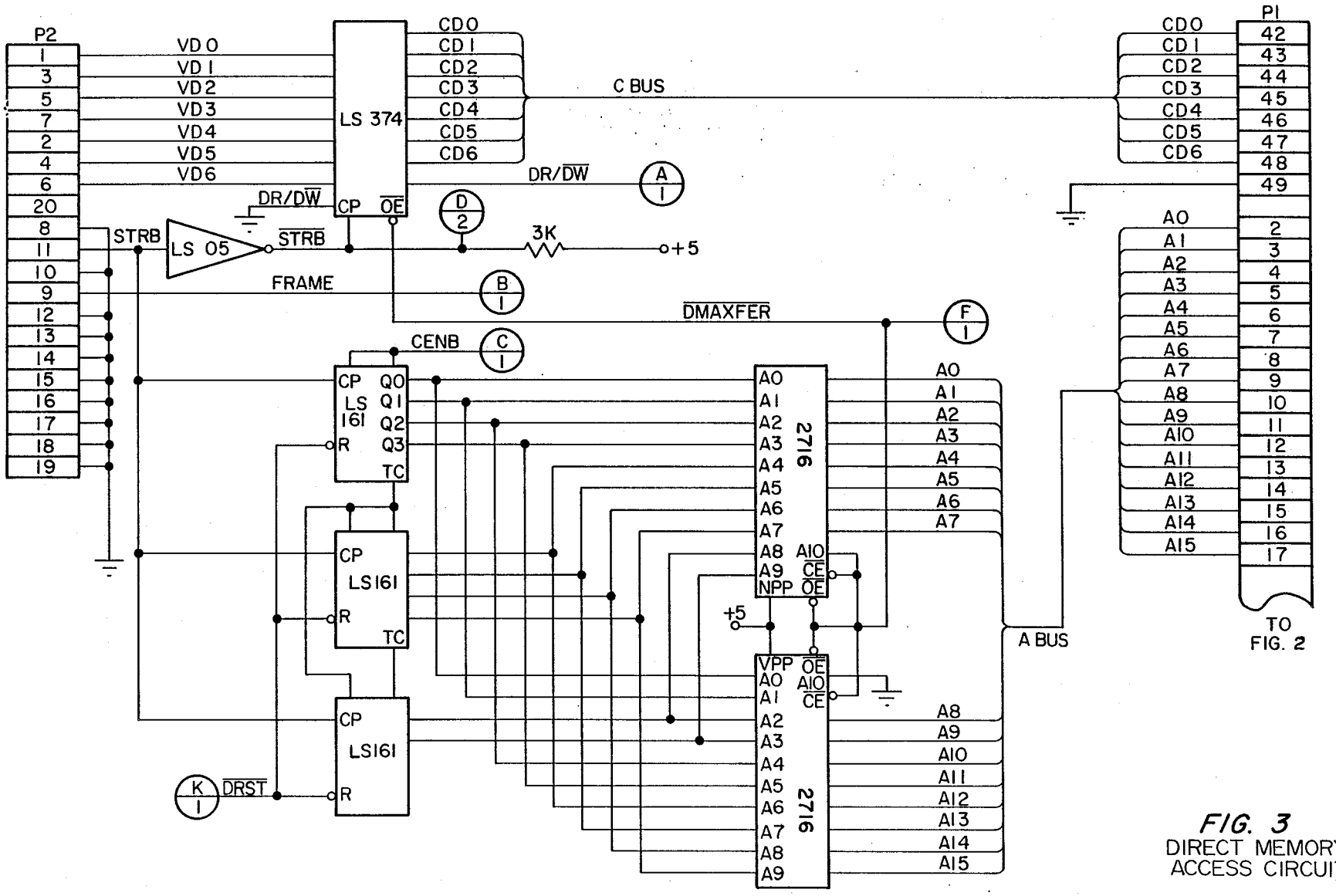

FIGS. 2 and 3 illustrate the direct memory access (DMA) circuit of the present invention. In the presently preferred embodiment, the DMA card connects to another of the redundant slot connectors in the personal computer. The DMA card facilitates data flow from the support electronics to the personal computer, and generates control signals that are also useful in transferring information from the personal computer to the support electronics. The P1 and P2 connectors to the DMA card are similar or identical to the P1 and P2 connectors to the I/O interface card. In the presently preferred embodiment, the location of the cards may be switched so long as the new location of each card is made known to the computer to facilitate proper generation of card enable signals.

Referring to FIG. 3, information from the support electronics, connected to the P2 connector, is communicated to the personal computer, connected to the P1 connector. The circuitry shown at FIG. 2 is operative to generate control signals, including the transfer signal, DMAXFR, timed to coincide with an available time for transfer of information from the support electronics into the personal computer. In the presently preferred embodiment, the information from the support electronics is loaded into the computer via the P1 connector a frame at a time. The frame synchronization signal, FRAME, is used to trigger the generation of the DMA transfer signal, DMAXFR.

The LS138 register illustrated at FIG. 2 is adapted to receive address information along with other data signals from the computer indicative of whether the DMA card is to be on, off, or whether a diagnostic function is to be performed. A non-maskable interrupt, NMI signal, is generated to, inter alia, facilitate transfer of the data to the computer at any time, regardless of competing utilization of the facilities of the personal computer. The NMI signal is generated in response to the presence of the interupt enable signal, INTENB, the data present signal, 01 and FRAME. $\phi 0$ and $\phi 1$ are timing signals associated with the microprocessor. They are used by the microprocessor to subdivide the time associated with one cycle in the device. Electrically, each is the inverse of the other. To correctly assert the NMI signal, the signal must be initiated during $\phi 1$ or an additional cycle will occur before the unit responds correctly.

FIG. 3 illustrates the circuitry for communicating information from the support electronics P2 connector to the personal computer P1 connector. Data information from the P2 connector (from the support electronics) is communicated to the LS374 register via data lines, VD0–VD6. The signal DR/DW is used to set the direction of the LS374 register to permit data transfer onto the data lines CD0–CD6, for communication to the P1 connector. The LS374 register is enabled by the occurrence of the strobe signal STRB, indicating that data is present, and the data transfer signal DMAXFR, which enables transfer to the personal computer at a non-reserved time.

The LS161 registers and the 2716 memory circuits are responsive to the strobe signals so as to generate an address corresponding with the data simultaneously communicated from the support electronics. Thus, the 2716 memory circuits provide an address in the memory of the personal computer in which to store the contemporaneous data information from the support electronics FIGS. 4, 5 and 6 of the drawings illustrate the color coding and color translation circuitry of the invention. In the presently preferred embodiment, the circuitry illustrated on FIGS. 4, 5 and 6 is incorporated into a single circuit board that is connected to the computer via the P1 connector, i.e., the normal slot connector, and the P3 connector, which, in the presently preferred embodiment, is implemented as hard wire connections to the mother board of the personal computer. The P3 connector essentially taps the data stream communicated from the data source to the computer and communicates that data stream directly to the video circuitry. Accordingly, the present invention eliminates the need to communicate the ongoing data stream to the processing circuitry of the computer.

Referring to FIGS. 3 and 4, it can be seen that the data information from the support electronics, labeled VD0–VD6, is communicated from the support electronics, via the P2 connector, to the pins 42–48 of the P1 connector. That information enters the computer and can be operated on by the computer, with the data output of the computer appearing at pins 42–49 of the P1 connector, as shown at FIG. 4. However, in the present invention the video circuit is hard wired to the mother board of the computer via the P3 connector, such that the same raw data that is communicated to the computer via the P1 connector, pins 42–48, is extracted from the computer mother board via the P3 connector, pins 1–8. The need to process that data is, therefore, eliminated, reducing the system demands on computer time and avoiding time delays associated with internal processing within the computer.

Once the color registers have been coded, the raw data extracted via the P3 connector is translated directly into color intensity levels to drive the RGB color monitor. Information extracted from the computer via the P1 connector (FIG. 4) is used only to set up or modify the coded color registers (FIG. 5) to correlate output color intensity levels to be one of any number of possible input signal levels, sixteen in the presently preferred embodiment.

Accordingly, FIG. 4 illustrates the two signal paths used to communicate signals to the color bus and the enable bus that control the operation of the color registers. FIG. 5 illustrates the color registers that are coded in accordance with the information from the P1 connectors and operated in response to the signals from the P3 connector. The outputs from the color registers are communicated to the digital analog converters shown at FIG. 6, which generate analog color intensity signals that are used to drive the RGB color monitor.

Referring again to FIG. 4, the data information D0–D7 is output from the computer via the P1 connectors and loaded onto the color bus that is communicated to the color registers illustrated at FIG. 5. The particular register that is loaded at a particular time is determined by the address information on lines A4–A6. The address information on lines A4–A6 is communicated to the LS138 register which translates the address information into load text (LT) and load graphics (LG) signals corresponding to various combinations of the colors red, green and blue. Those combinations find conformance with the outputs from the color registers illustrated at FIG. 5. The information from that LS138 register is loaded into a pair of LS157 registers and an LS373 register. The information from the LSl57 registers is communicated onto the enable bus in response to the input/output strobe signal IOS.

The information from the LS373 register is communicated onto the enable bus in response to the load signal LD. A0–A3 output from the LS157 register are derived either from VAS0-VAD3 or DAD0-DAD3, depending on the state of the IOS signal to the LS157 in FIG. 4. The normal running state of the system is with graphic information being displayed and this state uses VAD0-VAD3. The signals A0–A3 provide an address for the LS189 register (FIG. 5) in which the translation value for data intensity to color value is kept. Since these units lose their information when the lower is turned off, provisions to load the information when the system is initialized or to change the information at any given time has been provided. To accomplish this, the program writes data to the slot address associated with the color group to be modified. This address is input via A0–A6 on P1 along with the IOS signal indicating incoming program controlled data. A0–A3 specifies the magnitude value to modify while A4–A6 specifies the color group to modify the new values contained in D0–D8 input through P1 at the same time period. D0–D7 must contain the red and green values, or just the blue value, depending on the register group selected. During any programmed input, all register groups switch to the program mode during IOS, allowing alternate information to be put on the color and address busses. The IOS, $\phi 0$ and $R/\overline{W}$ signals from P1 are used to generate a e,ovs/LD/ signal that allows the memory to accept this new information.

The load signal from the ½ LS 139 register is generated in response to the IOS signal and the signal 00 which is generated whenever data is communicated to the P1 connector by the computer. The bit signal (BIT), output from the P3 connector, indicates that the next bit in the raster scan is valid. The bit signal is used to operate the LS139 register which in turn controls enablement of the background color for text and graphics loaded into the color registers of FIG. 5 the background color signals control the color of the display pixel during the time that no other information is available. They are the default colors unless changed by input data. The ½ LSl39 receives a decoded signal $T/\overline{G}$ bit derived from the magnitude of the video data. Using the bit signal input to both synchronize with the raster scan and provide information to decide if the intensity color value or background color is to be utilized, the LS139 provides one of four possible conditions: intensity color and graphic mode, background color and graphic mode, text data and text mode, backgound color and text mode with B·GR, $\overline{B}$·GR, B·TXT and $\overline{B}$·TXT respectively. These control signals subsequently enable the proper color register groups in FIG. 5 by decoding the signals to the enable bus via the LS157 registers. The SIP register (FIG. 4) is a single in-line package of pull up resistors used to hold an unselected line in the high or +5 state.

The outputs from the color registers, illustrated at FIG. 5, are communicated to the digital analog converters shown at FIG. 6, which convert the information on the red, green and blue buses to analog output signal levels which, along with the synchronization and ground signal, are communicated to the color monitor.

The color registers illustrated in FIG. 5 are coded such that they output different signals in response to a particular digital sequence on the color bus. In the presently preferred embodiment the number of output signals is related to the desired intensity of a particular color. Thus, when all red outputs are enabled, R0–R3, the display illustrates the red signals at a high intensity level. When only one red output signal, e.g., R0, is enabled, the red portions of the display exhibit low intensity levels. As is well known in the art, the red, green and blue color drive signals can be intermixed to generate various additional colors, with the intensity of those colors also being adjustable in the same manner.

Though it is to be understood that various types of color coding schemes may be implemented within the scope of the present invention, the circuitry illustrated at FIG. 5 discloses one embodiment of the invention utilizing a plurality of registers to control the color output signal of the text and graphics information that is communicated to the video circuit. It is anticipated that in many applications the relative intensity of the text information is of less significance than the relative intensity of the graphics information. Therefore, the disclosed embodiment operates to associate only two colors with the text information; one for background off color, and another one for a text on color. The color of the text information is controlled by the output of the lower LS374 registers shown at FIG. 5, and the color of the graphic signals is determined by the output of the upper LS189 and LS374 registers, also illustrated at FIG. 5.

Color intensity levels associated with various input signals may be modified in response to signals from either the support electronics, which may be integrated into the data stream communicated to the computer via the P1 connector, as shown at FIG. 3. Alternatively, modifications in the color intensity levels associated with one or more input signals may be modified in response to inputs from the keyboard of the computer Where it is desired to modify the intensity levels associated with one or more of the characteristics of the input data, the support electronics or the keyboard are operative to generate a signal sequence effective to trigger an interrupt signal which interrupts the flow of data from the P3 connector (FIG. 4) to the color bus. The information stored in one or more of the color registers is then modified, i.e. modifying the correspondence between one of the input sequences and the output color/intensity level. In the presently preferred embodiment a signal is communicated to the data input lines D0–D7, which is directed to a particular color register in accordance with the address information on lines A4–A6. As a result, such that when that color register is addressed, a different sequence is output than the sequence previously output when that same location was addressed. The different sequence corresponds to different intensity levels which appear on the RGB color monitor.

Accordingly, the invention operates to selectively utilize the processing ability of the relatively simple computer to allow selective adjustment of color intensity levels in a display system. The circuit avoids the need to utilize the processing facilities of the computer for ongoing translation of data information into color intensity levels, implementing processing routines only to set up and adjust the color intensity levels associated with the various input signals.

It is to be understood that the invention is not to be limited by the precise circuitry used to implement the color coding and color translating functions of the invention. Moreover, it is anticipated that the precise manner of implementing the color translation and color coding functions will depend upon the particular structure of the associated computer. In the presently preferred embodiment, the invention was implemented on a computer manufactured by Apple Computers, Inc. However, with modifications that should be apparent to those skilled in the art, the same functions and advantages can be achieved through the utilization of a variety of other types of personal computers, or other comparable devices.

Similarly, the number of potential color and/or intensity variations may be modified in view of the number of potential variations in the input signal and the desire to provide intensity level variations for text information.

It is also to be understood that the programming information to implement the color coding functions may be stored in the associated computer in any of a number of available locations. In the presently preferred embodiment, those routines are stored in the text portion of the computer memory so as to not encumber the graphics memory, which may be used by the computer for other purposes. Exemplary program code suitable to implement those functions is submitted herewith as Appendix A.

What is claimed is:

1. A color display system for converting input data into color drive signals wherein individual color intensity levels corresponding with individual data input signals may be selectively varied, said system comprising:

an interface circuit connectable to an external data source and first connector terminals of a general purpose programmable device having processing facilities, said interface circuit being adapted to transfer data and control signals between the programmable device and the data source;

a memory access circuit connectable to the data source and to second connector terminals of the programmable device, said memory access circuit comprising circuitry for generating address information for correspondence with data received from the data source, said memory access circuit being adapted to transfer said data from the data source and said corresponding address information to said second connector terminals of said programmable device; and a video circuit connected to second and third connector terminals of said programmable device and an external color display, said video circuit further being connectable to receive said data from the data source via said third connector terminals and corresponding address information via said second connector terminals, said video circuit comprising:

color registers for storing color drive signals;

color coding circuitry for loading said color registers and said address information, said address information corresponding to desired color intensity levels such that particular data from the data source corresponds with particular color intensity levels; and color translating circuitry for communicating said data from said data source to said color registers after said color registers have been loaded, said color translating circuitry being adapted to convert data from said data source into color drive signals for communication to an external color display;

wherein the processing facilities of said programmable device are utilized to generate address information loaded into the color registers, but the transfer of said data from said data source to said video circuit proceeds independent of said processing facilities; and wherein the processing facilities of the programmable device do not participate in the conversion of data from said data source into color drive signals after the color registers are loaded.

2. The system as recited in claim 1 wherein said third connector terminals are connectable to a mother board of the programmable device.

3. The system as recited in claim 1 wherein said data from the data source comprises digital signals.

4. The system as recited in claim 1 wherein said color coding circuitry is adapted to reload individual color registers such that the output of said individual color registers corresponds to a different color intensity level.

5. The system as recited in claim 1 wherein said control signals from the programmable device includes control information to control the operation of the data source.

6. The system as recited in claim 1 wherein said address information correlates the data received from the data source to a color intensity level, said address information being selectively modifyable to change the color intensity level associated with certain data without modifying the color intensity level associated with other data.

7. The system as recited in claim 1 wherein said address information may be stored in a memory circuit within said general purpose programmable device, said memory circuit being independently accessable by both the programmable device processing facilities and said memory access circuit.

* * * * *

UNITED STATES PATENT AND TRADEMARK OFFICE

CERTIFICATE OF CORRECTION

PATENT NO. : 4,942,388

DATED : July 17, 1990

INVENTOR(S) : William Reitman

It is certified that error appears in the above—identified patent and that said Letters Patent is hereby corrected as shown below:

Column 1, line 63, after "interfaces" delete --,--.

Column 1, line 67, after "processor," insert --or--.

Column 5, line 64, after "register" insert --,--.

Column 6, line 34, after "generate a" delete "e,ovs/LD/" and insert --$\overline{LD}$--

Signed and Sealed this

Sixth Day of August, 1991

*Attest:*

*Attesting Officer*

HARRY F. MANBECK, JR.

*Commissioner of Patents and Trademarks*